US006055396A

United States Patent [19]

Pang

[11] Patent Number: 6,055,396

[45] Date of Patent: Apr. 25, 2000

[54] LASER PRINTER HAVING A DISTANCE AND TENSION CONTROLLER

[75] Inventor: Jeong-hun Pang, Suwon, Rep. of Korea

[73] Assignee: Samsung Electronics Co., Ltd., Kyungki-do, Rep. of Korea

[21] Appl. No.: 09/072,669

[22] Filed: May 6, 1998

[30] Foreign Application Priority Data

Jul. 18, 1997 [KR] Rep. of Korea ..... 97-18998

[51] Int. Cl.[7] ..... G03G 15/00; G03G 15/16

[52] U.S. Cl. ..... 399/164; 347/154; 399/162; 399/165; 399/302; 399/308

[58] Field of Search ..... 399/162, 164, 399/302, 308, 318, 165; 347/154, 153

[56] References Cited

U.S. PATENT DOCUMENTS

| | | | |
|---|---|---|---|
| 4,062,631 | 12/1977 | Ichikawa et al. | 399/164 |
| 4,531,825 | 7/1985 | Miwa et al. | 399/318 X |
| 4,586,807 | 5/1986 | Yuasa . | |
| 4,752,800 | 6/1988 | Matui | 399/162 X |
| 5,239,351 | 8/1993 | Mahoney | 399/164 |
| 5,483,330 | 1/1996 | Ogiyama et al. | 399/318 |
| 5,489,972 | 2/1996 | Shuster et al. . | |
| 5,565,975 | 10/1996 | Kumon et al. | 399/302 |
| 5,583,629 | 12/1996 | Brewington et al. | 399/302 |
| 5,671,467 | 9/1997 | Katsumata et al. | 399/164 |
| 5,807,651 | 9/1998 | Rimai et al. | 399/302 X |

FOREIGN PATENT DOCUMENTS

| | | |
|---|---|---|
| 0 159 740 | 10/1985 | European Pat. Off. . |
| 57-41674 | 3/1982 | Japan . |
| 60-164784 | 8/1985 | Japan . |
| 2-95364 | 7/1990 | Japan . |
| 8-220899 | 8/1996 | Japan . |
| 9-34329 | 2/1997 | Japan . |

*Primary Examiner*—Susan S. Y. Lee
*Attorney, Agent, or Firm*—Sughrue, Mion, Zinn, Macpeak & Seas, PLLC

[57] ABSTRACT

A laser printer which includes a photosensitive belt of a loop type having a seam at a portion where the ends overlap. The photosensitive belt circulates around a driving roller, a steering roller and a transfer backing roller, as well as passes between the transfer backing roller and a transfer roller. The laser printer also includes a distance controller which moves the transfer backing roller toward and away from the transfer roller.

14 Claims, 4 Drawing Sheets

LASER PRINTER HAVING A DISTANCE AND TENSION CONTROLLER

BACKGROUND OF THE INVENTION

1. Field of the Invention

The present invention relates to a laser printer, and more particularly, to a laser printer using a photosensitive belt having a seam.

2. Description of the Related Art

In general, in a laser printer, developer is coated on a photosensitive belt to form an image, and then the image developed on the photosensitive belt is transferred to a roller to print the image on a sheet of paper.

An example of a laser printer is schematically illustrated in FIG. 1. The laser printer includes a transfer backing roller 11*a*, a steering roller 11*b* and a driving roller 11*c*. An photosensitive belt 12 is rotatably installed around the rollers 11*a*, 11*b* and 11*c*.

At one side of the photosensitive belt 12, there is an eraser 23 for erasing image information of a previous step, and a charger 24 for uniformly electrifying the photosensitive belt 12 passing through the eraser 23. The image information recorded on the photosensitive belt 12 of the previous step is erased by the eraser 23, and then the charger 24 applies a predetermined voltage to the photosensitive belt 12 to be charged.

Also, at one side of the photosensitive belt 12, of a color printer, passing between the steering roller 11*b* and the driving roller 11*c*, there is a plurality of laser scanners 25 and developing devices 26 for combining colors. The laser scanner 25 scans light corresponding to received image information to form a photosensitive region on the photosensitive belt 12. In the developing device 26, a developer is coated on the photosensitive region formed by the laser scanner 25.

The image developed on the photosensitive belt 12 is transferred to a transfer roller 17 to print an image on a sheet of paper 19 by being pressed by a pressure roller 18.

Here, the photosensitive belt 12 is a loop type belt, and has a seam 12a where end portions of the belt 12 overlap. As the photosensitive belt 12 circulates along the rollers 11*a*, 11*b* and 11*c*, the seam 12*a* of the photosensitive belt 12 can be caught between the transfer backing roller 11*a* and the transfer roller 17. Also, some of the developer may remain at the seam 12*a*, to thereby contaminate the paper 19.

Accordingly, in the conventional art, when the photosensitive belt 12 passes between the transfer backing roller 11*a* and the transfer roller 17, the transfer roller 17 and the pressure roller 18 separate a predetermined distance from the backing roller 11*a*, to thereby prevent the seam 12*a* from being caught.

During printing, since the transfer roller 17 is coupled with the pressure roller 18, the two rollers 17 and 18 should operate simultaneously. Thus, much time is required for operation, and the structure of the mechanism for controlling the distance between the transfer roller 17 and the backing roller 11*a* is complicated.

SUMMARY OF THE INVENTION

To solve the above problems, it is an object of the present invention to provide a laser printer capable of easily passing a seam of a photosensitive belt between a transfer roller and a transfer backing roller.

Accordingly, to achieve the above and other objects of the present invention, the laser printer of the present invention includes: a photosensitive belt of a loop type having a seam at a portion where the ends overlap; wherein the photosensitive belt circulates around a driving roller, a steering roller and a transfer backing roller, such that it passes between the transfer backing roller and a transfer roller; and a distance controller which moves the transfer backing roller toward and away from the transfer roller.

Preferably, the distance controller comprises a cam unit for separating the transfer backing roller from the transfer roller when the seam of the photosensitive belt passes between the transfer roller and the transfer backing roller.

It is also preferable that the cam unit comprises a connection member connected to a rotation shaft of the transfer backing roller, as well as a cam contacting the bottom of the connection member. The cam includes flat and rounded portions to lower and raise the connection member. The cam unit further includes driving means for driving the cam.

The laser printer further comprises a tension controller for controlling the tension of the photosensitive belt according to the movement of the transfer backing roller.

BRIEF DESCRIPTION OF THE INVENTION

The above objects and advantages of the present invention will become more apparent by describing in detail a preferred embodiment thereof with reference to the attached drawings in which.

DESCRIPTION OF THE PREFERRED EMBODIMENTS

Figure 1:
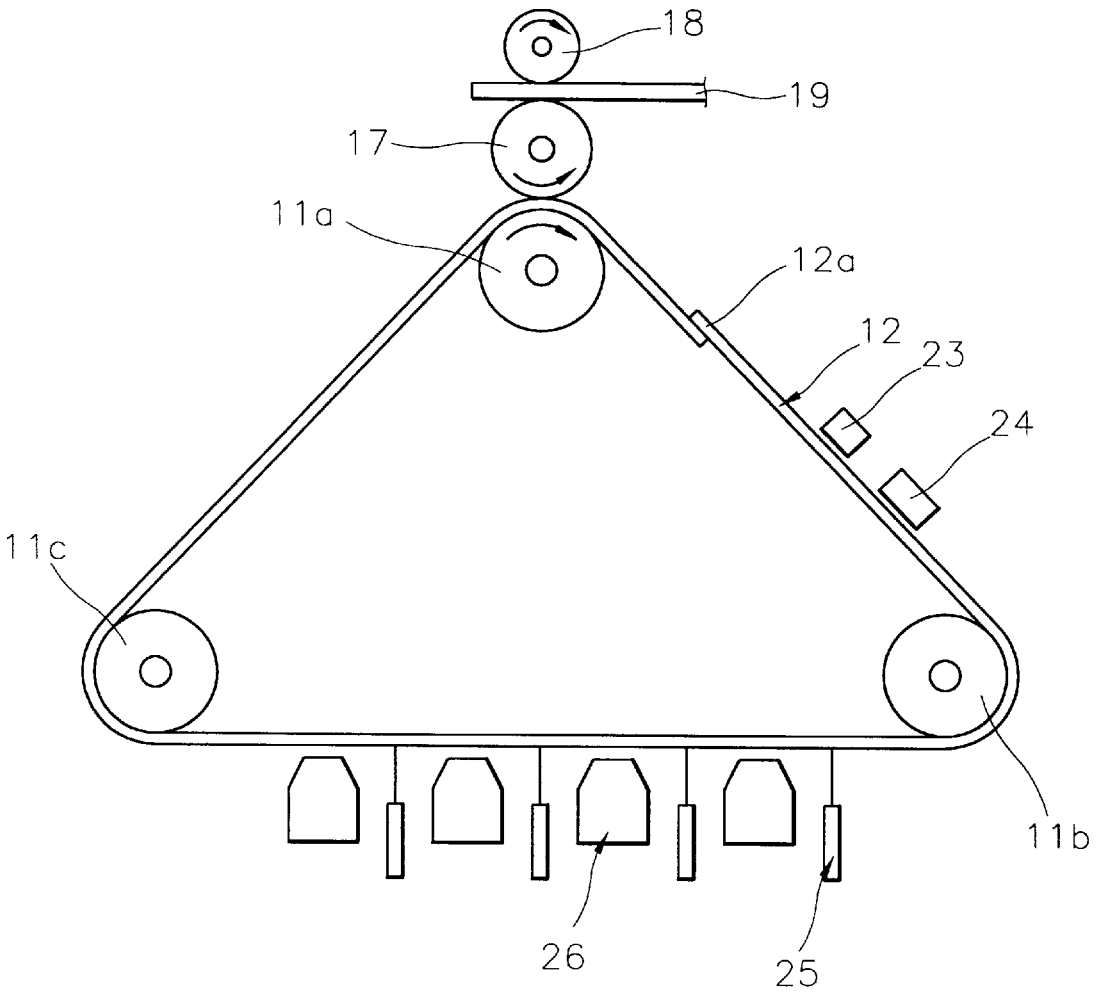
FIG. 1 (PRIOR ART)
FIG. 1 is a diagram schematically illustrating the photosensitive belt and related portions of a conventional laser printer.
Figure 2:
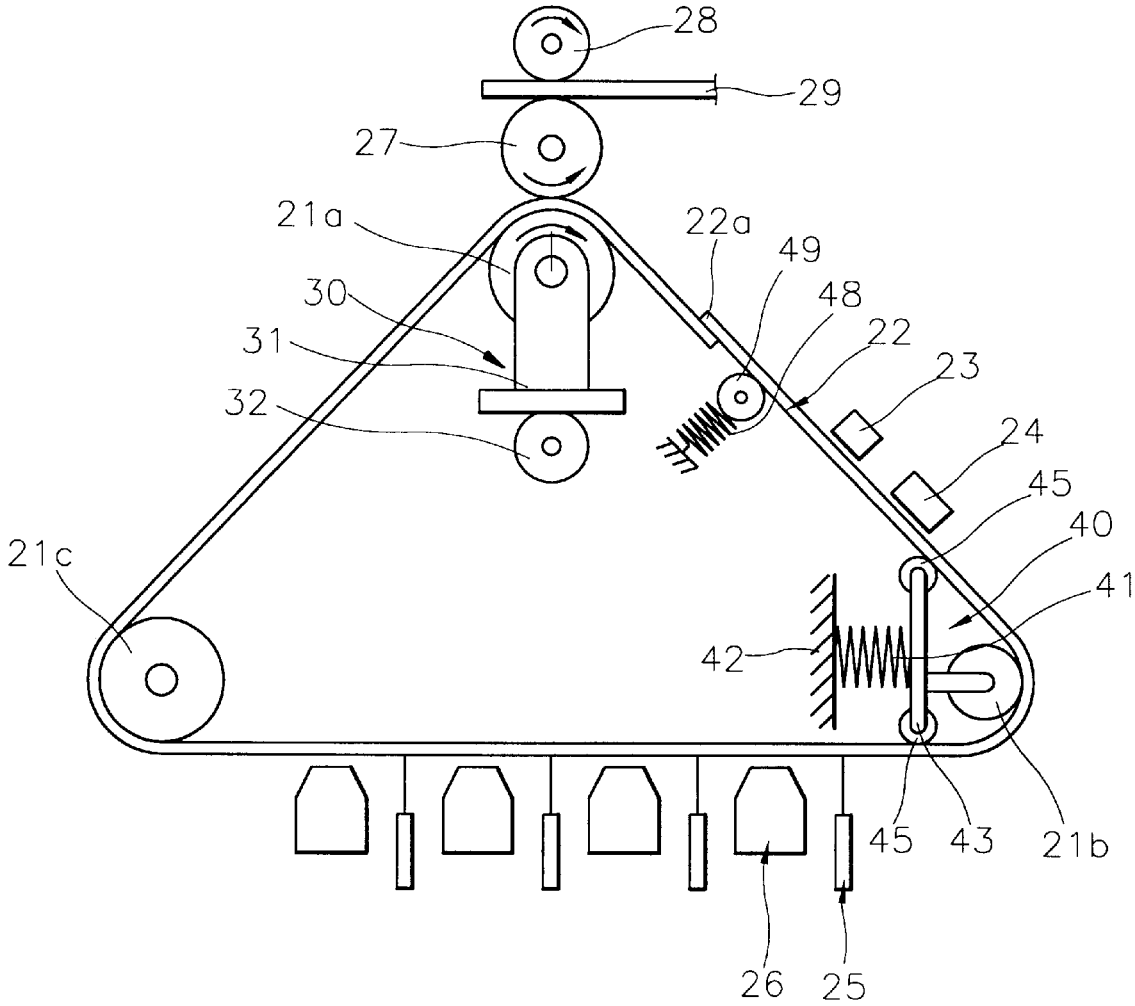
FIG. 2 is a diagram schematically illustrating the photosensitive belt and related portions of a laser printer according to the present invention.

Referring to FIG. 2, a laser printer according to the present invention includes a transfer backing roller 21*a*, a steering roller 21*b* and a driving roller 21*c*. A photosensitive belt 22, on which image information is recorded, is rotatably installed in a loop around the rollers 21*a*, 21*b* and 21*c*. The photosensitive belt 22 includes a seam 22*a* where end portions of the photosensitive belt 22 overlap. Throughout the drawings, reference numerals which are the same as those in FIG. 1 represent similar elements. The transfer roller 27 is rotatably coupled with the transfer backing roller 21*a* and the photosensitive belt 22 is interposed therebetween. Accordingly, the image information formed on the photosensitive belt 22 is transferred to the transfer roller 27. The transfer roller 27 rotates with the pressure roller 28 between which a sheet of paper 29 passes. Thus, the paper 29 is pressed by the pressure roller 28 against the transfer roller 27 and is printed with the image information on the transfer roller 27.

In the present invention, when the photosensitive belt 22 passes between the transfer backing roller 21*a* and the transfer roller 27, the transfer backing roller 21*a* is separated from the transfer roller 27. The separation of rollers 21*a* and 27 prevents the seam 22*a*, formed at an overlapped portion of the photosensitive belt 22, from being caught by the rollers 21*a* and 27.

A distance controller 30, for elevating the transfer backing roller 21*a*, is required such that the transfer backing roller 21*a* is separated by a predetermined distance. It is preferable to connect the distance controller 30 to a rotation shaft of the transfer backing roller 21*a*. A cam unit can be used as the distance controller 30. Also, for example, a rack and pinion may be used as a means for elevating the transfer backing roller 21*a*.

Figure 3:
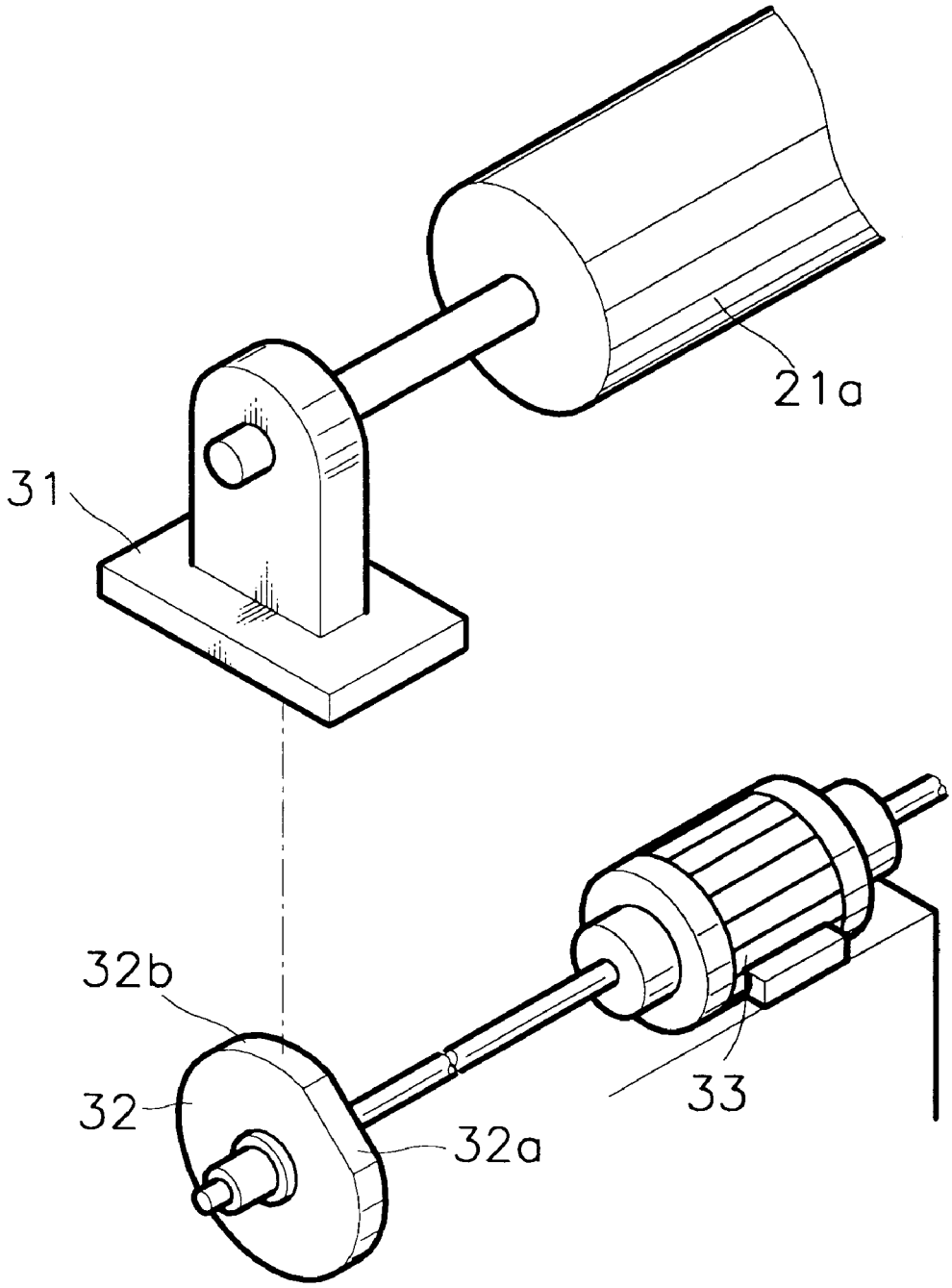
FIG. 3 is a perspective view showing a distance controller of a transfer backing roller used for the laser printer according to the present invention.

FIG. 3 shows the distance controller 30 in detail. The distance controller includes a connection member 31, a cam 32 and a driving means 33. That is, the connection member 31 is connected to the rotation shaft of the transfer backing roller 21*a*, and is moved downwards along a guide (not shown). The cam 32 has an outer circumference composed of a flat portion 32*a* and a rounded portion 32*b* and is installed below the surface of the connection member 31. The cam 32 is rotated by the driving means 33, e.g., a driving motor.

When the seam 22*a* of the photosensitive belt 22 is close to the portion between the transfer backing roller 21*a* and the transfer roller 27, the flat portion 32*a* of the cam 32 contacts with the bottom surface of the connection member 31 to lower the connection member 31. Accordingly, the transfer backing roller 21*a* connected to the connection member 31 separates from the transfer roller 27 by a predetermined distance so that the seam 22*a* of the photosensitive belt 22 does not contact the transfer roller 27.

When the transfer backing roller 21*a* is lowered, a tension controller 40 operates to prevent the photosensitive belt 22 from becoming loose. The tension controller 40 is installed to operate together with the steering roller 21*b*.

Figure 4:
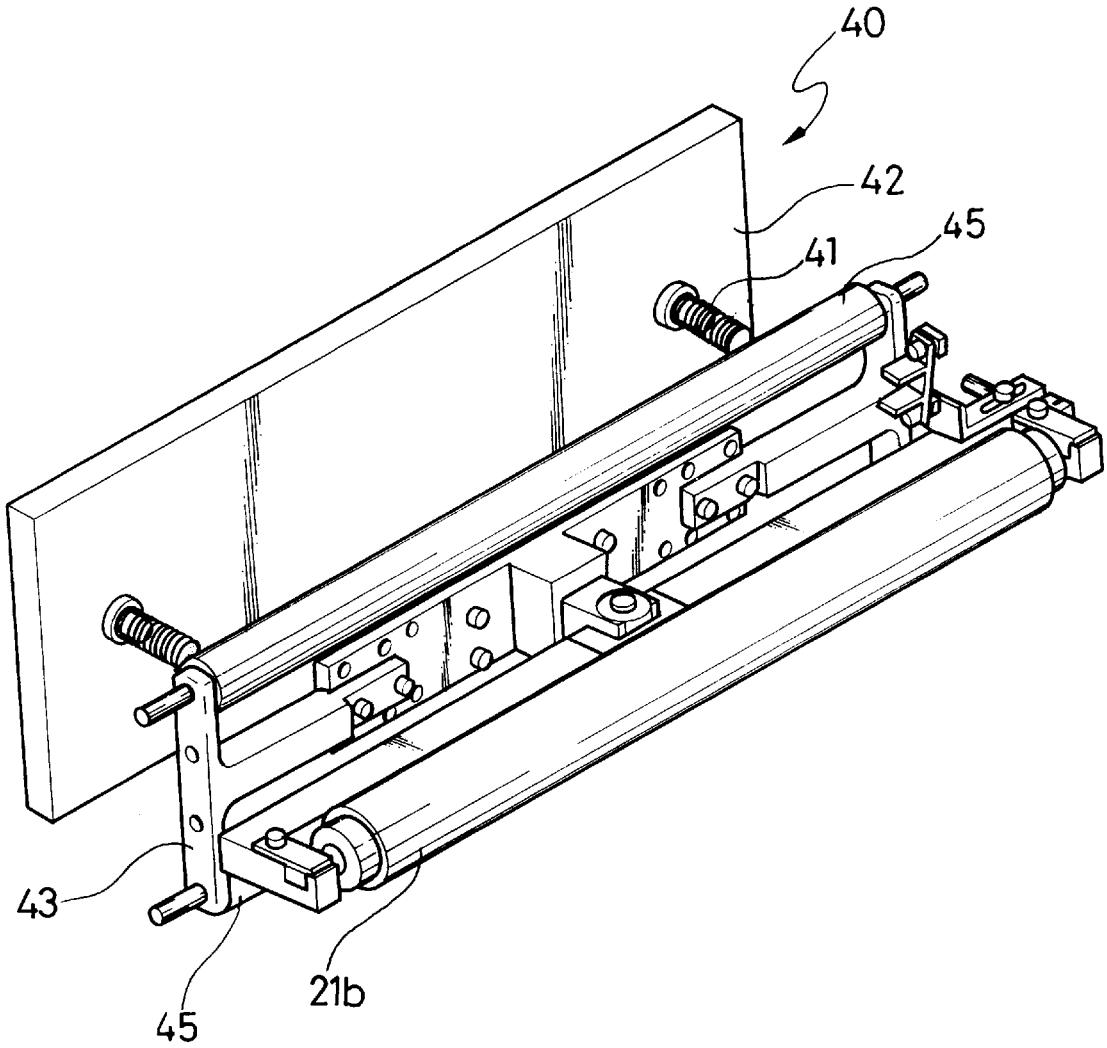
FIG. 4 is a perspective view showing a tension controller of a photosensitive belt used for the laser printer according to the present invention.

The tension controller 40 includes an elastic member 41, such as a spring, for applying a biasing force to the steering roller 21*b* to prevent the photosensitive belt 22 from becoming loose. As shown in FIG. 4, the tension controller 40 includes a support frame 43 which supports the shaft of the steering roller 21*b*. The elastic member 41 is connected to the support frame 43 to press the steering roller 21*b* toward the photosensitive belt 22. Also, it is preferable to install auxiliary support rollers 45 parallel to the steering roller 21*b*, and in contact with the photosensitive belt 22, on both sides of the support frame 43. Thus, the elastic member 41, fixed to a fixing plate 42 applies a biasing force to the support frame 43, which moves the steering roller 21*b* toward the photosensitive belt 22 and further elastically supports the photosensitive belt 22. That is, the tension controller 40 controls the tension of the photosensitive belt 22. When the photosensitive belt is loosened by the operation of the distance controller 30, the tension controller 40 prevents the photosensitive belt 22 from becoming loose.

Therefore, according to the laser printer of the present invention, when the seam 22*a* of the photosensitive belt 22 passes between the transfer backing roller 21*a* and the transfer roller 27, the transfer backing roller 21*a* moves downwards by operation of the distance controller 30 to loosen the photosensitive belt 22. Due to the loosened photosensitive belt 22, pressure applied to the elastic member 41 by the steering roller 21*b* and/or the auxiliary support rollers 45 is reduced. The elastic member 41 thus moves in a direction to compensate for the reduced pressure. The movement of the elastic member 41 in turn is imparted to steering roller 21*b*. Accordingly, loosening of the photosensitive belt 22 is prevented due to movement of the steering roller 21*b*.

In addition to the above, the tension controller can include one or more photosensitive belt tensioning rollers 49 each having an elastic member 48, adjacent to the transfer backing roller 21*a* may compensate for the loosening of the photosensitive belt 22 due to movement of the transfer backing roller 21*a*.

After the seam 22*a* of the photosensitive belt 22 has passed between the transfer backing roller 21*a* and the transfer roller 27, the rounded portion 32*b* of the cam 32, instead of the flat portion 32*a*, comes into contact with connection member 31 as the cam 32 rotates. Thus, the connection member 31 rises to return the transfer backing roller 21*a* to its initial position.

As described above, according to the laser printer of the present invention, when the seam 22*a* of the photosensitive belt 22 passes between the transfer roller 27 and the transfer backing roller 21*a*, the distance controller 30 connected to the rotation shaft of the transfer backing roller 21*a* and the tension controller 40 connected to the steering roller 21*b*, simultaneously operate. Accordingly, by a simplified mechanism, the seam 22*a* of the photosensitive belt 22 passes through without contacting the transfer roller 27.

Also, during a standby mode of printing, the flat portion 32*a* of the cam 32 contacts the bottom of the connection member 31 to lower the transfer backing roller 27. Then, the photosensitive belt 22 thus does not contact the high-temperature transfer roller 27 so that the photosensitive belt is protected from heat thereby increasing its life span.

It should be understood that the invention is not limited to the illustrated embodiment. Many changes and modifications can be made within the scope of the invention, by one of ordinary skill in the art, which are intended to be encompassed within the protection sought for the invention as set forth in the appended claims.

What is claimed is:

1. A laser printer comprising:

a photosensitive belt of a loop type having a seam at a portion where the ends overlap, said photosensitive belt circulates around a driving roller, a steering roller and a transfer backing roller, said photosensitive belt further passes between the transfer backing roller and a transfer roller;

a distance controller which moves the transfer backing roller toward and away from the transfer roller, wherein the distance controller comprises a cam unit which separates the transfer backing roller from the transfer roller when the seam of the photosensitive belt passes between the transfer roller and the transfer backing roller; and a tension controller which controls the tension of the photosensitive belt according to the movement of the transfer backing roller.

2. The laser printer of claim 1, wherein the distance controller separates the transfer backing roller from the transfer roller during a standby mode of printing.

3. The laser printer of claim 1, wherein the cam unit comprises a connection member connected to a rotation shaft of the transfer backing roller, a cam contacting the bottom of the connection member wherein said cam includes flat and rounded portions to lower and raise the connection member, and a driving means for driving the cam.

4. The laser printer of claim 3, wherein said flat portion contacts said connection member such that said transfer backing roller is separated from said transfer roller during a standby mode of printing.

5. The laser printer of claim 1, wherein the tension controller comprises a photosensitive belt tensioning roller adjacent to the transfer backing roller, such that said photosensitive belt tensioning roller rotatably contacts the photosensitive belt and an elastic member which biases the photosensitive belt tensioning roller toward the photosensitive belt.

6. The laser printer of claim 1, wherein the tension controller comprises an elastic member which biases the steering roller toward the photosensitive belt.

7. The laser printer of claim 1, wherein the tension controller comprises a support frame which supports a shaft of the steering roller, an auxiliary support roller installed on each side of the support frame, each auxiliary support roller is parallel to the steering roller and contacts the photosensitive belt, and an elastic member which applies a biasing force to the support frame.

8. A laser printer comprising:

a photosensitive belt of a loop type having a seam at a portion where the ends overlap, said photosensitive belt circulates around a driving roller, a steering roller and a transfer backing roller, said photosensitive belt further passes between the transfer backing roller and a transfer roller; and a distance controller which moves the transfer backing roller toward and away from the transfer roller, wherein the distance controller comprises a cam unit which separates the transfer backing roller from the transfer roller when the seam of the photosensitive belt passes between the transfer roller and the transfer backing roller.

9. The laser printer of claim 8, wherein the cam unit comprises a connection member connected to a rotation shaft of the transfer backing roller, a cam contacting the bottom of the connection member wherein said cam includes flat and rounded portions to lower and raise the connection member, and a driving means for driving the cam.

10. The laser printer of claim 9, wherein said flat portion contacts said connection member such that said transfer backing roller is separated from said transfer roller during a standby mode of printing.

11. A laser printer comprising:

a photosensitive belt of a loop type having a seam at a portion where the ends overlap, said photosensitive belt circulates around a driving roller, a steering roller and a transfer backing roller, said photosensitive belt further passes between the transfer backing roller and a transfer roller;

a distance controller which moves the transfer backing roller toward and away from the transfer roller; and a tension controller which controls the tension of the photosensitive belt according to the movement of the transfer backing roller.

12. The laser printer of claim 11, wherein the tension controller comprises a photosensitive belt tensioning roller adjacent to the transfer backing roller, such that said photosensitive belt tensioning roller rotatably contacts the photosensitive belt and an elastic member which biases the photosensitive belt tensioning roller toward the photosensitive belt.

13. The laser printer of claim 11, wherein the tension controller comprises an elastic member which biases the steering roller toward the photosensitive belt.

14. The laser printer of claim 11, wherein the tension controller comprises a support frame which supports a shaft of the steering roller, an auxiliary support roller installed on each side of the support frame, each auxiliary support roller is parallel to the steering roller and contacts the photosensitive belt, and an elastic member which applies a biasing force to the support frame.

* * * * *